US005167112A

United States Patent [19]

Stenmans

[11] Patent Number: 5,167,112

[45] Date of Patent: * Dec. 1, 1992

[54] THREAD PROCESSING MACHINE SPINDLE ASSEMBLY HAVING MECHANICAL ADJUSTMENT MECHANISMS FOR DEVICES WITHIN A ROTATING THREAD BALLOON

[75] Inventor: Heinz Stenmans, Grefrath, Fed. Rep. of Germany

[73] Assignee: Palitex Project Company GmbH, Krefeld, Fed. Rep. of Germany

[ * ] Notice: The portion of the term of this patent subsequent to Sep. 29, 2008 has been disclaimed.

[21] Appl. No.: 674,562

[22] Filed: Mar. 25, 1991

[30] Foreign Application Priority Data

Mar. 29, 1990 [DE] Fed. Rep. of Germany ..... 4010018

[51] Int. Cl.[5] ..... D01H 1/10; D01H 7/86; D01H 13/16

[52] U.S. Cl. ..... 57/58.52; 57/58.83; 57/80

[58] Field of Search ..... 57/58.49, 58.52, 58.57, 57/58.7, 58.83, 80, 87, 264

[56] References Cited

U.S. PATENT DOCUMENTS

| | | | |
|---|---|---|---|
| 2,830,432 | 4/1958 | Berthold | 57/58.49 |
| 2,831,311 | 4/1958 | Berthold | 57/58.49 |
| 2,834,179 | 5/1958 | Nishimura | 57/80 |
| 3,290,873 | 12/1966 | Vibber | 57/58.83 |
| 3,299,623 | 1/1967 | Keyser | 57/58.49 |
| 3,410,071 | 11/1968 | Heimes | 57/58.49 |
| 3,415,049 | 12/1968 | Nimtz | 57/58.49 |
| 3,623,312 | 11/1971 | Gutbrod | 57/58.49 X |
| 3,950,927 | 4/1976 | Kallman | 57/264 X |
| 4,222,221 | 9/1980 | Lenorak | 57/58.49 |
| 4,453,377 | 6/1984 | Inger et al. | 57/87 X |
| 4,856,268 | 8/1989 | Colli | 57/58.52 |
| 4,930,301 | 6/1990 | Kawarabashi | 57/80 |

FOREIGN PATENT DOCUMENTS

| | | |
|---|---|---|
| 1510853 | 4/1971 | Fed. Rep. of Germany . |
| 2246174 | 4/1974 | Fed. Rep. of Germany . |
| 2315601 | 7/1974 | Fed. Rep. of Germany . |
| 2628125 | 12/1977 | Fed. Rep. of Germany . |

*Primary Examiner*—Katherine Matecki
*Assistant Examiner*—Michael R. Mansen
*Attorney, Agent, or Firm*—Bell, Seltzer, Park & Gibson

[57] ABSTRACT

A spindle assembly of a thread processing machine, such as a cabling or double twisting machine, includes an axially-extending hollow spindle shaft defining a thread passageway, a pot mechanism mounted coaxial with and surrounding the hollow spindle shaft and around which a balloon of thread rotates during thread processing, thread deflection device positioned above the pot mechanism coaxial with the hollow spindle shaft for receiving thread being processed from the rotating balloon of thread and for changing the direction of thread travel from generally radial to axial, and adjustable devices for influencing the mode of operation of the spindle assembly and mounted thereon within the rotating thread balloon formed during thread processing. The improvement is provided of a movable mechanical linkage extending from outside of the rotating thread balloon to within the rotating thread balloon and to the spindle assembly operation influencing devices and monuted for movement to adjust such devices.

10 Claims, 2 Drawing Sheets

THREAD PROCESSING MACHINE SPINDLE ASSEMBLY HAVING MECHANICAL ADJUSTMENT MECHANISMS FOR DEVICES WITHIN A ROTATING THREAD BALLOON

FIELD OF THE INVENTION

This invention relates to a spindle assembly of a thread processing machine, such as a cabling or double (two-for-one) twisting machine, wherein the spindle assembly includes an axially-extending hollow spindle shaft defining a thread passageway, a pot mechanism mounted coaxial with and surrounding the hollow spindle shaft and around which a balloon of thread rotates during thread processing, a thread deflection device positioned above the pot mechanism coaxial with the hollow spindle shaft for receiving thread being processed from the rotating balloon of thread and for changing the direction of thread travel from generally radial to axial, and adjustable means for influencing the mode of operation of the spindle assembly and mounted thereon within the rotating thread balloon formed during thread processing.

BACKGROUND OF THE INVENTION

It is customary to arrange on such spindle assemblies as the operation influencing means, for example, thread brakes, twisted-thread flyer brakes, twisted-thread flyer arrangements or the like. These elements, which are important for the thread course or the mode of operation of the spindle, are, during the orderly spindle run, practically protected from any influence from the outside or at least such an influencing is made difficult. This is disadvantageous, and measures are desired which make it possible to have an influence on such elements, which are provided for example within the stationary supply bobbin carrier mounted on the spindle, without complex mechanisms being necessary.

It is known to influence the controllable functional elements electrically and/or magnetically, as is described for example, in German patent publications DE-PS 15 10 853 and DE-PS 15 10 854 (corresponds to U.S. Pat. No. 3,410,071).

Until now, however, in practice no functionally reliable measures have been known with which it is possible, during operation of the spindle, to act from the outside on movable control members or other functional elements on or respectively in the supply bobbin carrier.

OBJECT AND SUMMARY OF THE INVENTION

The problem underlying the invention is to provide a device with which it is possible to have an influence from the outside mechanically on functional elements or control members which are arranged in the region of the supply bobbin carrier and during orderly operation of the spindle are encased by the thread balloon hitherto considered as impenetrable.

To solve this problem in accordance with the present invention, there is provided in a spindle assembly of a thread processing machine, such as a cabling or double twisting machine including an axially-extending hollow spindle shaft defining a thread passageway, a pot mechanism mounted coaxial with and surrounding the hollow spindle shaft and around which a balloon of thread rotates during thread processing, thread deflection means positioned above the pot mechanism coaxial with the hollow spindle shaft for receiving thread being processed from the rotating balloon of thread and for changing the direction of thread travel from generally radial to axial, and adjustable means for influencing the mode of operation of the spindle assembly and mounted thereon within the rotating thread balloon formed during thread processing; the improvement of movable mechanical linkage means extending from outside the rotating thread balloon to within such rotating thread balloon and to the spindle assembly operation influencing means. This mechanical linkage means is mounted for movement to adjust such means during orderly operation of the spindle and includes hollow sleeve means for axial movement in the location of the thread deflection means and coaxial with the hollow shaft and having at least one lateral aperture for receiving thread to pass radially into the aperture and axially through the sleeve at the deflection means and for axial movement with the linkage means during adjustment of the spindle assembly operation influencing means.

Further details of this improvement will be seen in the description of preferred embodiments of this invention to be described hereinafter.

BRIEF DESCRIPTION OF THE DRAWINGS

The invention will be described in more detail hereinunder with reference to the drawings.

DETAILED DESCRIPTION OF PREFERRED EMBODIMENT OF THE INVENTION

Figure 1:
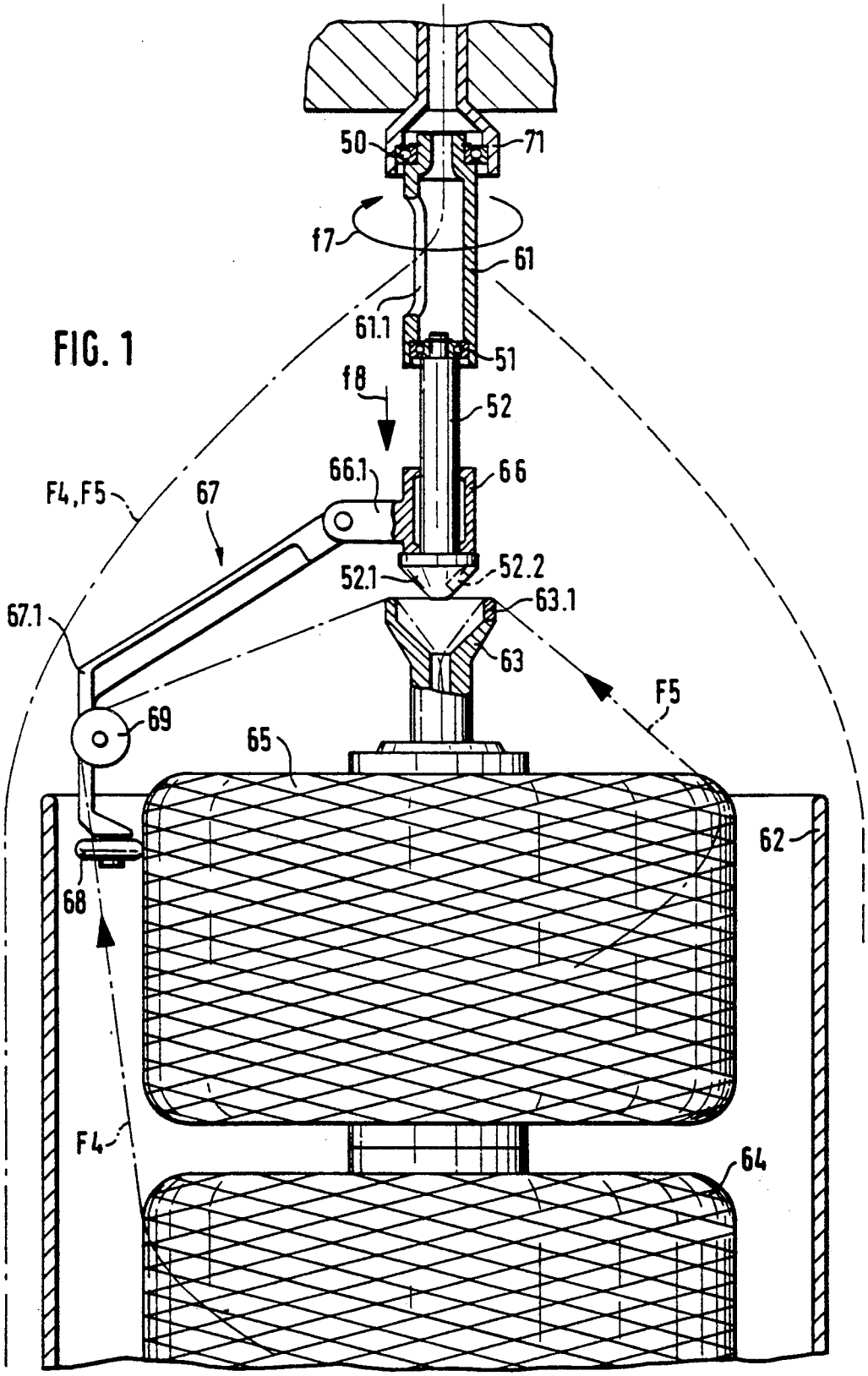
FIG. 1 shows partially in section a side view of an embodiment of a two-for-one twisting spindle with a so-called double affixing of presentation or supply bobbins.

FIG. 1 shows, of a two-for-one twisting spindle assembly, the upper end of the bobbin pot jacket 62, the upper end of the thread entry tube 63, the aperture of which is widened in a funnel-shaped manner, and two supply bobbins 64 and 65 which are affixed one above the other and from which the threads are drawn off overhead, i.e. upwardly, and run jointly into the thread entry tube 63.

The two threads F4 and F5 then run jointly through the spindle hollow shaft, before they leave the customary thread storage disc, not shown, through the radially extending thread guide duct and along with the formation of a balloon run to the sleeve 61 which is arranged in the region of the apex of the balloon and which in the present case exercises the function of the otherwise customary balloon thread guide. The lower - end of the spindle assembly is not shown herein; however, reference may be had to copending U.S. patent application Ser. No. 674,676, filed Mar. 25, 1991, the disclosure of which is incorporated herein by reference.

The sleeve 61 is, for the entry of the twine thread F4, F5, provided with a lateral aperture 61.1 in the form of an elongate slot. The sleeve 61 is mounted so as to be rotatable by means of a bearing 50 in a retaining tube 71 which lies in the extension of the sleeve and which is for its part mounted so as to be adjustable in the axial direction on the machine frame, as will be described in connection with FIG. 3.

Inserted into the lower end of the sleeve is a further bearing 51 for a pin 52 which is coaxial with the spindle shaft and which carries at its lower end a cone body 52.1, the shape of which is preferably adapted to the shape of the entry funnel at the upper end of the thread entry tube 63. In order to secure the pin 52 against rotation, preferably inserted in the cone body 52.1 is a retaining magnet 52.2, with which counter-magnets 63.1 in the upper end of the thread entry tube 63 are associated.

The pin 52 serves in accordance with FIG. 1 as a bearing pin for a twisted-thread flyer arrangement. For this purpose, slipped onto the bearing pin 52 is a bush 66, on which a carrier 66.1 is affixed. Hinged to the carrier 66.1 is an elbowed lever arm 67, which has at its free end a lever portion 67.1 which projects into the gap between the protective pot jacket 62 and the upper presentation bobbin 65. Affixed to the lower end of this lever portion 67.1 is a roller 68, which is rotatable about a substantially vertical axis. Mounted so as to be rotatable on the lever portion 67.1 is, moreover, a thread guide roller 69, over which the thread F4 coming from the lower presentation bobbin 64 runs. The thread F5 coming from the upper presentation bobbin 65 runs without the support of a run-off aid directly to the thread entry tube 63.

With the bobbin diameter becoming smaller, the twisted-thread flyer arrangement is swivelled further to the center of the spindle shaft. In this respect it is at all times ensured that the thread F4 coming from the lower presentation bobbin 64 can be drawn off in a contact-free manner relative to the upper presentation bobbin 65. In this way it is ensured that the thread F4 coming from the lower presentation bobbin runs in a disturbance-free manner past the upper presentation bobbin 65.

During orderly operation of the spindle or in the event of a thread breakage, by axial lowering of the retaining tube 71, the cone body 52.1 can be run into the upper end of the thread entry tube 63, in order to provide a thread breaking action or to prevent a possible further undesired draw-off of the thread.

In the case of the arrangement in accordance with FIG. 1, the sleeve 61 is set rotating, as indicated by the arrow F7, by the twine thread F4, F5 entering laterally into the sleeve. The diameter of the slotted sleeve 61 working as a balloon thread guide is preferably so selected that the thread F4, F5 running laterally into the slot 61.1 exerts a sufficiently high torque on the sleeve 61.

Figure 2:
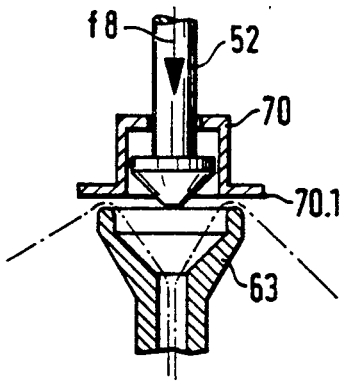
FIG. 2 shows in enlarged representation a sectional view of a detail of a modified embodiment of a two-for-one twisting spindle.

In accordance with the embodiment of FIG. 2, slipped onto the pin 52 is a downwardly open cap 70, which has an outwardly directed flange ring 70.1, which lies opposite the upper edge of the thread entry tube 63 which is widened in a funnel-shaped manner. This cap 70 forms a entry aid in the form of a loading weight. Such an entry aid is used when it is a matter of additionally braking threads prior to entry into the thread entry tube, in which respect a further special task lies in preventing the entry of loops in the individual thread into the thread entry tube or respectively the spindle hollow shaft.

The braking force exerted by the cap 70 can in the appropriate circumstances be varied by the application of additional weights, or else by the choice of appropriate caps having different weights.

For the lowering of the retaining tube 7, and thus, of the sleeve 61 and of the pin 52 provided with the cone body 52.1 in the direction of the arrow f8, any suitable adjusting mechanism with manual or other actuating devices can be used, preferably a pneumatic piston/cylinder arrangement for instance in such a way that affixed on the retaining tube 71 is a piston 73 which is guided in a pressure cylinder 72.

Figure 3:
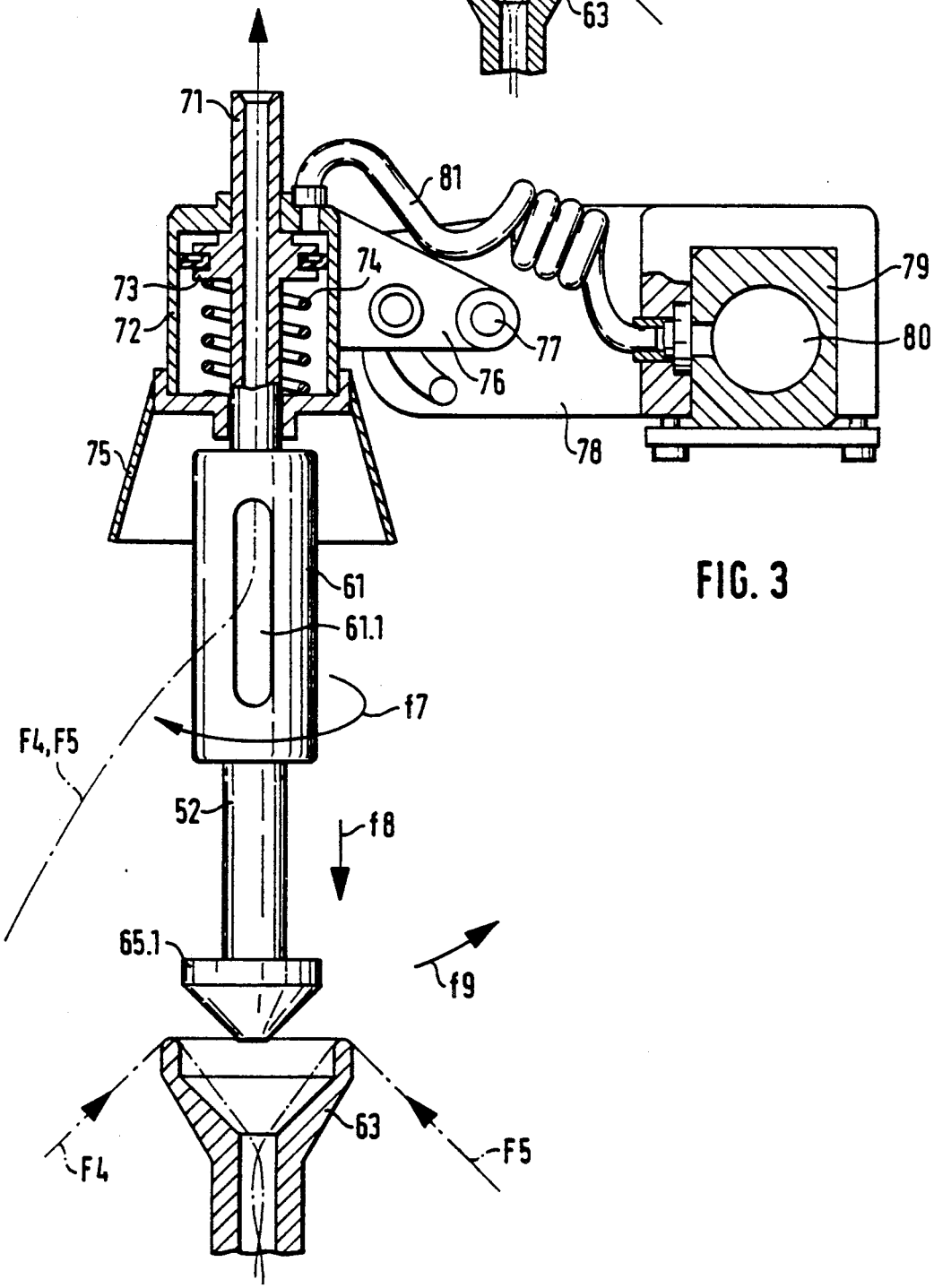
FIG. 3 shows partially in section a side view of the upper portion of a two-for-one twisting spindle.

In order to facilitate the operation of such a two-for-one twisting spindle, in accordance with FIG. 3 preferably the retaining tube 71 or the pressure cylinder 72 provided for the adjustment of the retaining member 71 is mounted swingably (arrow f9) on the machine frame. For this purpose, fastened laterally to the pressure cylinder 72 is a strap 76, which is mounted on a mounting support 78 so as to be swivellable about the axis 77. The mounting support 78 is mounted on the machine frame, which is represented by a beam 79, through which a compressed-air line 80 is conducted. Connected to this compressed-air line 80 is a branch line 81, which leads to the pressure cylinder 72, in such a way that the upper side of the piston 73 can be acted upon contrary to the force of a restoring spring 74 with compressed air, in order to displace the sliding sleeve 61 together with the pin 52 downwards.

Preferably a protective cap 75 is fastened to the underside of the pressure cylinder 72.

I claim:

1. In a spindle assembly of a thread processing machine wherein said spindle assembly includes an axially-extending hollow spindle shaft defining a thread passageway, a pot mechanism mounted coaxial with and surrounding said hollow spindle shaft and around which a balloon of thread rotates during thread processing, thread deflection means positioned above said pot mechanism coaxial with said hollow spindle shaft for receiving thread being processed from the rotating balloon of thread and for changing the direction of thread travel from generally radial to axial during thread processing, and adjustable means for influencing the mode of operation of said spindle assembly during orderly operation of said spindle assembly for processing thread and mounted thereon within the rotating thread balloon formed during thread processing; the improvement of:

movable mechanical linkage means for extending from outside the rotating thread balloon to within such rotating thread balloon and to said spindle assembly operation influencing means and mounted for movement to adjust said spindle assembly operation influencing means during orderly operation of said spindle assembly and including a hollow sleeve mounted for axial movement in the location of said thread deflection means and coaxial with said hollow shaft and having at least one lateral aperture for receiving thread to pass radially into said aperture and axially through said sleeve at said deflection means and for axial movement with said linkage means during movement thereof for adjustment of said spindle assembly operation influencing means.

2. In a spindle assembly, according to claim 1, in which said mechanical linkage means further includes a bearing connected to the upper end of said sleeve, and a retaining tube having the lower end thereof connected with said bearing for rotatably carrying said sleeve and being mounted for axial movement to provide for axial movement of said sleeve.

3. In a spindle assembly, according to claim 2, in which said mechanical linkage means further includes a piston connected to said retaining tube, a pressure cylinder containing said piston, compressed air means for acting on one side of said piston means within said cylinder means, and a restoring spring acting on the other side of said piston within said cylinder.

4. In a spindle assembly, as set forth in claim 3, in which said mechanical linkage means further includes a mounting support carried by said spindle assembly, and strap means pivotally mounted on said mounting support for swinging about an axis and having said pressure cylinder mounted thereto.

5. In a spindle assembly, as set forth in claims 1 or 2, in which said spindle assembly further includes a thread entry tube connected to and axially-extending upwardly from said hollow spindle shaft for receiving thread to be processed; in which said mechanical linkage means further includes a bearing connected to the lower end of said sleeve, a pin member having one end thereof connected to said bearing and extending axially downwardly from said sleeve; and in which said spindle assembly operation influencing means comprises a cone-shaped member connected to or integrally formed on the bottom end of said pin member, and a widened funnel-shaped upper end on said thread entry tube for receiving said cone shaped member on the lower end of said pin member during axial movement of said mechanical linkage means.

6. In a spindle assembly, according to claim 5, in which said spindle assembly operation influencing means further includes an open cap member having an outwardly directed flange ring movably mounted on said pin member and surrounding said cone-shaped member for engaging the upper edges of said funnel-shaped end of said thread entry tube upon axial movement of said mechanical linkage means.

7. In a spindle assembly, as set forth in claim 6, further including a thread flyer swingably mounted on said pin member which acts as a bearing therefor.

8. In a spindle assembly, as set forth in claim 7, in which said spindle assembly further includes a pair of superimposed supply bobbins of thread mounted on said hollow spindle shaft and within said pot mechanism to form a gap between the outside surfaces of said supply thread bobbins and the inside surface of said pot mechanism; and in which said thread flyer further includes a bush forming the bearing mounting of said thread flyer onto said pin member, an elbowed lever arm having one end connected to said bush and having the other end thereof projecting into the gap between the inside surface of said pot mechanism and the outside surface of said thread supply bobbin, and a roller affixed to said projecting end of said lever arm for contacting the outer surface of said thread supply bobbin and positioning said lever arm.

9. In a spindle assembly, as set forth in claim 8, in which said thread flyer further includes a roller rotatably mounted on said lever arm for receiving a thread coming from the lower of said supply bobbins.

10. In a spindle assembly, as set forth in claim 5, further including a magnet positioned in said cone-shaped member on the end of said pin member and a counter-magnet positioned within said funnel-shaped upper end of said entry tube.

* * * * *